US012384649B2

(12) United States Patent
Bungter et al.

(10) Patent No.: US 12,384,649 B2
(45) Date of Patent: Aug. 12, 2025

(54) YARN ACCUMULATOR UNIT FOR A WORKSTATION OF A TEXTILE MACHINE

(71) Applicant: Saurer Spinning Solutions Gmbh & Co. KG, Uebach-Palenberg (DE)

(72) Inventors: Stefan Bungter, Wegberg (DE); Martin Reszat, Luenen (DE); Peter Eggers, Aachen (DE)

(73) Assignee: Saurer Spinning Solutions GmbH & Co. KG, Übach-Palenberg (DE)

( * ) Notice: Subject to any disclaimer, the term of this patent is extended or adjusted under 35 U.S.C. 154(b) by 271 days.

(21) Appl. No.: 17/836,401

(22) Filed: Jun. 9, 2022

(65) Prior Publication Data

US 2022/0396901 A1 Dec. 15, 2022

(30) Foreign Application Priority Data

Jun. 10, 2021 (LU) ..... 102827

(51) Int. Cl.
*B65H 59/00* (2006.01)

(52) U.S. Cl.
CPC ..... *B65H 59/005* (2013.01); *B65H 2701/31* (2013.01); *D01H 2700/22* (2013.01)

(58) Field of Classification Search
CPC .. B65H 59/005; B65H 59/34; B65H 2701/31; B65H 63/04; B65H 57/06; B65H 57/14; B65H 57/28
See application file for complete search history.

(56) References Cited

U.S. PATENT DOCUMENTS 6,375,112 B1 * 4/2002 Engelhardt ..... B65H 59/005 242/417
7,896,279 B2 * 3/2011 Comotto ..... D03D 47/34 242/419.3

(Continued)

FOREIGN PATENT DOCUMENTS

DE 19754561 A1 6/1999
EP 0284144 B1 * 3/1988 ..... B65H 59/36

(Continued)

OTHER PUBLICATIONS

Luxembourg Search Report, Luxembourg Application No. LU102827, dated Mar. 11, 2022, 10 pages.

*Primary Examiner* — Anna M Momper
*Assistant Examiner* — Katelynne R Burrell
(74) *Attorney, Agent, or Firm* — Nelson Mullins Riley & Scarborough LLP

(57) ABSTRACT

A yarn accumulator unit for a workstation with a yarn guide arm pivotally mounted about a pivot axis, and a controllable drive unit for reversing pivoting of the yarn guide arm. The yarn guide arm is to be freely rotatably mounted and to have a magnetically acting first coupling element arranged at a distance from the pivot axis, and for the drive unit to have a second magnetic coupling element arranged so as to be adjustable transversely to the first coupling element or about the pivot axis, magnetically repulsively acting on the first coupling element, which second magnetic coupling element is arranged so that it can be brought into active connection with the first coupling element on the drive unit, in which case an adjustment of the second coupling element in the direction of the first coupling element causes a displacement of the first coupling element in the same direction.

6 Claims, 5 Drawing Sheets

(56) References Cited

U.S. PATENT DOCUMENTS

| | | | | |
|---|---|---|---|---|
| 9,475,670 | B2 * | 10/2016 | Barea | D03D 47/366 |
| 2007/0278054 | A1 | 12/2007 | Huss et al. | |
| 2019/0071276 | A1 * | 3/2019 | Stusak | B65H 59/005 |
| 2020/0310388 | A1 * | 10/2020 | Pilar | D01H 13/104 |
| 2024/0391731 | A1 * | 11/2024 | Sprecher | B65H 59/005 |

FOREIGN PATENT DOCUMENTS

| | | | | |
|---|---|---|---|---|
| EP | 1975106 | B1 | 7/2012 | |
| EP | 3409625 | A1 * | 12/2018 | B65H 54/103 |
| EP | 2955142 | B1 | 6/2020 | |
| JP | S5852150 | A | 3/1983 | |

* cited by examiner

YARN ACCUMULATOR UNIT FOR A WORKSTATION OF A TEXTILE MACHINE

CROSS-REFERENCE TO RELATED APPLICATION

This application claims priority from Luxembourg Patent Application No. LU102827, filed Jun. 10, 2021, entitled "Beschreibung Oberriemchenhalter für ein Riemchenstreckwerk einer Textilmaschine", the entire contents of which are incorporated herein by reference in its entirety.

FIELD OF THE INVENTION

The present invention relates to a yarn accumulator unit for a workstation, in particular for a spinning and/or winding unit, of a textile machine, with a yarn guide arm pivotally mounted about a pivot axis, and a controllable drive unit for reversing pivoting of the yarn guide arm.

BACKGROUND OF THE INVENTION

In connection with workstations, in particular with spinning and/or winding units, of a textile machine, e.g. spinning machines and winding machines, placing a controlled yarn accumulator unit in front of the traversing devices along a yarn path for winding of cross-wound packages, e.g. conical packages, has already been disclosed. These yarn accumulator units are used to adapt the yarn sags occurring when winding the packages to the constant yarn delivery speed, e.g. of a spinning device or spinning cop pull-off device. In textile machines of prior art, the take-up package is usually held during the winding process or the package journey in a pivotally mounted package cradle of a winding device downstream of the traversing device, and is usually driven by a friction roll via a frictional engagement or individually. In detail, the winding speed of the take-up package, depending on its wound diameter, corresponds to the constant yarn delivery speed by the spinning device, for example. During winding, the yarn is laid in a defined manner over the package width, in particular crosswise, by means of the traversing device. Due to the constant yarn delivery speed, there is a periodic loosening of the yarn, which is why, in order to maintain a desired yarn tension, it is necessary to compensate for the sag as the working path of the yarn is shortened along the yarn path.

In addition to compensating for the yarn sag, it is essential to keep the yarn tension as constant as possible during the winding process. In the prior art, such as European Patent Publication EP 2 955 142 A1, it has already been disclosed that yarn accumulator units can be configured with a yarn guide arm, which is pivoted into the area of the yarn path and thus temporarily extends the length of the regular working path of the yarn in a loop-forming manner. The yarn guide arm can usually be pivoted and positioned about a pivot axis transverse to the yarn path by means of a controllable electric drive. The electric drive is controlled by a control system which receives the output information for control from a yarn tension sensor. Depending on the yarn tension present during winding, the control system reacts in the form of a defined control of the electric drive and consequently of the yarn guide arm, as a result of which the yarn tension can be reduced or increased.

However, the systems of prior art suffer from the disadvantage that they are not suitable for keeping the yarn tension continuously constant going forward, particularly at relatively high winding speeds, especially when frequent changes in yarn tension occur due to various influences.

On this basis, the problem addressed by the present invention is one of providing a yarn accumulator unit which particularly reliably enables the yarn tension to be maintained as constantly as possible during the winding process.

SUMMARY OF THE INVENTION

The present invention solves the problem with a yarn accumulator unit for a workstation of a textile machine, with a yarn guide arm pivotally mounted about a pivot axis, and a controllable drive unit for reversing pivoting of the yarn guide arm, characterised in that the yarn guide arm is freely rotatably mounted and has a magnetically acting first coupling element arranged at a distance from the pivot axis, and the drive unit has a second magnetic coupling element which is arranged so as to be adjustable relative to the first coupling element, has a magnetically repulsive effect on the first coupling element, and is arranged so that it can be brought into active connection with the first coupling element on the drive unit, in which case an adjustment of the second coupling element in the direction of the first coupling element causes a displacement of the first coupling element in the same direction.

The present invention solves the problem with a workstation having a yarn delivery device for delivering a yarn, a traversing device for traversing the delivered yarn, and a yarn winding device for winding the traversed yarn onto a take-up package, which is arranged along a yarn path, characterised by a yarn accumulator unit having the above described features, which is arranged along the yarn path between the yarn delivery device and the traversing device to force the yarn running along the yarn path out of the yarn path in a defined manner by the pivoting movement of the yarn guide arm.

The present invention solves the problem with a method for setting a yarn tension of a running yarn at a workstation having the above described features, in which the sensor unit transmits sensor information about the rotary movement and/or position of the yarn guide arm to a control system assigned to the workstation, based on the transmitted sensor information, the control system evaluates a magnetic force acting between the first and second coupling element to identify a prevailing yarn tension and, in the event of a deviation from a limit value or limit value range for the yarn tension that is evaluated as impermissible, controls the drive unit in a defined manner to change the position of the yarn guide arm.

Advantageous further developments of the present invention are described herein.

A characteristic feature of the yarn accumulator unit according to the present invention is that the yarn guide arm is freely rotatably mounted and has a magnetically acting first coupling element arranged at a distance from the pivot axis. Furthermore, the drive unit has a second magnetic coupling element which is arranged so as to be adjustable relative to the first coupling element, and has a magnetically repulsive effect on the first coupling element. The second magnetic coupling element is arranged so that it can be brought into an active connection with the first coupling element via the drive unit, in which case an adjustment of the second coupling element in the direction of the first coupling element causes a displacement of the first coupling element in the same direction, and thus a pivoting of the yarn guide arm.

In contrast to yarn accumulator units that have already been disclosed, in which the yarn guide arm is directly forced to rotate on the drive shaft by a drive shaft of the drive unit, for example by means of a stationary bearing, and the force transmission is thus strictly effected by components contacting one another along the powerflow, the yarn guide arm according to the present invention is now freely rotatable, in particular on the drive shaft of the drive unit. This allows the rotational force generated by the drive shaft to be transmitted to the yarn guide arm without contact, utilising magnetically acting means. According to the present invention, the first and second coupling elements are aligned with one another in such a way that they exert a repulsive magnetic effect on one another. Consequently, when the second coupling element is displaced by the drive unit in the direction of the first coupling element, the repulsive effect between the first and second coupling elements results in a displacement of the first coupling element corresponding to the direction of movement of the second coupling element, in which case, as a result of the connection between the first coupling element and the yarn guide arm, the latter is pivoted about the pivot axis. In this respect, the yarn guide arm is displaced about its pivot axis without contact via the drive unit as a function of the set position of the second coupling element arranged on the drive unit.

By pivoting the yarn guide arm about the pivot axis into the yarn path, the yarn guide arm creates a loop-shaped course of the yarn in the area of the yarn accumulator unit, in which case the yarn guide arm can preferably engage with the yarn in the area between two yarn guide rollers or eyes arranged along a yarn path in order to create a defined loop course. Via the two coupling elements, a contactless adjustment of the yarn guide arm is effected by the drive unit. If a yarn surplus arises during the winding process, which leads to a decrease in yarn tension, then this is taken up in a loop between the preferably provided pair of yarn-guiding rollers or eyes and the yarn guide arm. If, on the other hand, less yarn is produced in the winding process than is required by the take-up package, e.g. the cross-wound package, as a result of which the yarn tension increases, the required yarn length is released from the loop by a backward displacement of the yarn guide arm, the second coupling element being adjusted for this purpose via the drive unit in such a way that the yarn guide arm is pivoted in an opposite direction pushing the yarn away, in which case a backward pivoting of the yarn guide arm results from the yarn tension acting on the yarn guide arm. The yarn guide arm thus follows the return movement of the second coupling element and releases the required yarn length in a defined manner. The yarn accumulator unit thus makes it possible to keep the yarn tension constant at an exact and high frequency via the freely rotatable yarn guide arm, so that a winding process can also be carried out at particularly high winding speeds, in which case both cylindrical and conical take-up packages can be manufactured particularly reliably.

Ideally, an adjustment movement of the yarn guide arm in the direction of the yarn, or in an opposite direction, takes place without a change in the distance between the first and second coupling elements and thus without a change in the magnetic spring force resulting from the distance between the two coupling elements. Preferably, an adjustment movement of the yarn guide arm can be controlled by a control system controlling the drive unit and a sensor unit that can be connected to the control system for transmitting detected sensor information. The control system is preferably configured to evaluate and assess the transmitted sensor information, and to control the drive unit in a defined manner based on the assessment result. The control system can preferably have a control unit as well as an evaluation and assessment unit. These units can be one and the same unit or units that differ from one another. Also, two units can be implemented with a single unit. The control system can further be a component of the yarn accumulator device or a component separate therefrom. Also, the arrangement of the control system can be freely selected. Thus, the control system can be provided in a workstation having the yarn accumulator unit, in a central machine control system and/or away from the textile machine. Redundant control by providing two such control systems that check or can check one another is also possible.

The sensor unit, which can be connected to the control system, can preferably be used to detect the rotary movement and/or the position of the yarn guide arm, in which case changes in the distance between the two coupling elements resulting from a change in the yarn tension can thus also be determined via the sensor information detected by the sensor unit. If the yarn guide arm has a position displaced in the direction of the second coupling element compared to the position set by the control system, i.e. if the distance between the first coupling element and the second coupling element decreases, then the magnetically generated spring force acting between the first and second coupling elements increases. Taking into account a known characteristic curve of the magnetic spring force previously stored in the control system or in a readable memory unit coupled to the control system, it is possible to deduce the yarn tensile force acting on the yarn and consequently the yarn tension via the control system. Subsequently, the yarn tension can be checked, adjusted and/or kept constant via the control system by changing the position of the second coupling element relative to the first coupling element by means of corresponding control of the drive unit.

The yarn accumulator unit thus enables the yarn tension to be kept constant at a particularly precise and high frequency.

The displacement of the second coupling element relative to the first coupling element by means of the drive unit can basically be configured in any way. For example, linear drives are conceivable here, which adjust the second coupling element in a linear manner in the direction of the first coupling element transversely to the pivot axis and thus effect a displacement of the yarn guide arm.

According to a particularly advantageous embodiment of the present invention, there is provision for the second coupling element to be arranged on a carrier which can be adjusted by means of the drive unit, in particular coaxially, about the pivot axis of the yarn guide arm. According to this embodiment of the present invention, the second coupling element is adjustable about the pivot axis of the yarn guide arm, in which case for this purpose the second coupling element is arranged on a carrier connected to the drive unit. The rotation of the carrier about the pivot axis of the yarn guide arm makes it possible to use particularly space-saving rotary drives for adjusting the second coupling element. In addition, a rotation of the second coupling element, which is particularly preferably arranged at the same distance from the pivot axis as the first coupling element, offers a particularly uniform and reliable adjustment, with the result that a particularly precise displacement of the yarn guide arm can be effected by the control system via a displacement of the carrier.

The arrangement of the first coupling element on the yarn guide arm is in principle freely selectable. According to a particularly preferred embodiment of the present invention, there is provision for the first coupling element to be detachably attached to the yarn guide arm and/or the second coupling element is detachably attached to the drive unit. This embodiment of the present invention makes it possible easily to change the first and/or second coupling element when necessary, with the result that adaptations to different production conditions that may require magnetic effects that differ from one another can be made in a simple manner. In addition, maintenance and repair work can be carried out particularly easily and quickly.

The configuration of the drive unit for displacing the second coupling element, in particular the carrier, can basically be selected freely, in which case various motor drives can be used here. According to a particularly advantageous embodiment of the present invention, however, there is provision for the drive unit to have an electric motor, in particular a stepper motor, with a drive shaft which is connected to the carrier in a torsionally rigid manner and on which the yarn guide arm is mounted so that it can rotate freely. Particularly preferably, the guide arm has a bearing unit at a free end, in particular a bushing element, by means of which the yarn guide arm can be placed on the free end of the drive shaft. The bearing unit is configured so that the yarn guide arm can rotate freely on the free end of the drive shaft, independently of a rotary movement of the drive shaft, i.e. without torque. Furthermore, the yarn guide arm preferably has a yarn guide section at its further free end, in particular a yarn guide eye or roller, for contacting and guiding the yarn. This allows the lever effect of the yarn guide arm to be utilised to the maximum extent. Other arrangement locations selected according to requirements, both of the bearing unit and of the yarn guide section along the longitudinal extension axis of the yarn guide arm, are also conceivable according to a further preferred embodiment.

According to this embodiment of the present invention, a particularly precise adjustment of the carrier about the pivot axis of the yarn guide arm is possible via the electric motor with a reversing effect. In addition, the drive shaft serves to accommodate the yarn guide arm in a freely rotatable manner, in which case a freely rotatable bearing or free rotational mobility is generally understood to mean a torque-free connection between the drive shaft and the yarn guide arm, so that the drive shaft serves solely the function of pivoting, in particular mounting in a pivoting arrangement, the yarn guide arm, but does not transmit any torque to the latter. A corresponding embodiment of the yarn accumulator unit furthermore enables it to have a particularly compact design, thus ensuring in a particularly reliable manner that a second coupling element arranged on the carrier can be adjusted over the same circumference about the drive shaft as the first coupling element, which is arranged at a corresponding distance from the axis of the drive shaft on the yarn guide arm.

The embodiment such that the first coupling element and the second coupling element achieve a magnetically repulsive effect on one another is basically freely selectable. For example, the first and/or second coupling element can be configured as electromagnets with magnetic fields that are aligned in such a way as to produce a repulsive effect on one another. The electromagnets can be controlled via the control system so that, if necessary, different magnetic fields can be generated via them in such a way that the repulsive effect can be adjusted and, in particular, regulated via the corresponding control system.

According to a particularly preferred embodiment of the present invention, there is provision for the first coupling element and the second coupling element to be configured as permanent magnets. The use of permanent magnets as coupling elements, which are appropriately aligned on the yarn guide arm and the carrier, represents a particularly simple and low-maintenance as well as low-cost option for providing a magnetic repulsive effect. The desired repulsive effect can be determined by selecting the permanent magnets.

The connection of the carrier to the drive unit, in particular to a preferably provided drive shaft of an electric motor, can be made by simple flange connections. According to a further development of the present invention, however, there is provision for the carrier to be arranged on a coupling disc which is arranged coaxially with the drive shaft and is connected to the drive shaft in a torsionally rigid manner. The use of a coupling disc ensures a particularly reliable displacement of the carrier and the second coupling element connected to the carrier about the pivot axis of the yarn guide arm. The coupling disc can rest against a corresponding counter surface of an advantageously provided electric motor for two-dimensional guidance.

A sensor unit is used to detect the rotary movement and/or position of the yarn guide arm, in particular to detect deviations from the position of the yarn guide arm compared to the position set by the control system via the drive unit, in which case the sensor unit can basically be arranged at any position. According to a preferred embodiment of the present invention, there is provision for the sensor unit to be configured and arranged for detecting the angle of rotation and/or position of a connection element which is connected to the yarn guide arm in a torsionally rigid manner and is arranged coaxially with the drive shaft, the sensor unit further preferably being arranged coaxially with the connection element. According to this embodiment of the present invention, a connection element connected to the yarn guide arm in a torsionally rigid manner extends in sections into the sensor unit, which is arranged at a distance from the end of the drive shaft. A corresponding arrangement of the sensor unit, in particular the arrangement preferably provided coaxially with respect to the connection element, enables a particularly precise detection of the rotary movement and/or position of the yarn guide arm, and moreover allows a particularly compact design of the yarn accumulator unit.

According to another aspect of the present invention, a workstation, in particular a spinning or winding unit, of a textile machine is proposed which has a yarn accumulator unit according to an embodiment described above. The workstation is further equipped with a yarn delivery device for delivering a yarn, a traversing device for traversing the delivered yarn, and a yarn winding device for winding the traversed yarn onto a take-up package. The yarn delivery device, the traversing device and the yarn winding device are arranged along a yarn path for appropriate processing of the yarn. The yarn path is such a path from the delivery location to the winding location along which the yarn runs during its package journey without being influenced by the yarn accumulator unit. The yarn accumulator unit is also arranged along the yarn path between the yarn delivery device and the traversing device to force the running yarn out of the yarn path during the package journey by means of the pivoting movement of the yarn guide arm. Particularly preferably, the yarn guide arm is arranged along the yarn path between two yarn guide rollers or eyes over which or through which the yarn is guided during its package journey. The yarn guide rollers or eyes can be carried by a paraffining device upstream of the traversing device along the yarn path and can be arranged upstream of a paraffining body of the paraffining device. This allows the yarn accumulator unit to be located close to the traversing device, utilising the lateral back and forth movement of the yarn generated by the traversing device transverse to the yarn path for uniform abrasion of the paraffining body over its width extending transverse to the yarn path and for uniform paraffining of the yarn.

According to a preferred embodiment, a control system as described above and a sensor unit that can be connected to the control system for the exchange of information as described above are associated with the workstation, in which case the sensor unit is configured and arranged for detecting the rotary movement and/or position of the yarn guide arm and for transmitting sensor information to the control system. The control system is preferably configured to evaluate and assess the transmitted sensor information, and to control the drive unit in a defined manner based on the assessment result. Preferably, the control system is configured to control the drive unit for regulating the yarn tension and/or the accumulation quantity of the guided yarn, and also preferably the sensor unit for calling up sensor information.

According to a preferred embodiment, a rest position of the yarn guide arm is provided in a position crossing the yarn path, in which the yarn guided by the yarn guide arm is forced out of the yarn path during the package journey. In other words, the yarn accumulator unit is arranged with the yarn guide arm along the yarn path in such a way that a rest position of the yarn guide arm, which corresponds to a zero position of the drive unit, is outside the yarn path and in the direction in which the yarn guide arm forces the yarn out of the yarn path. It is thus possible to ensure that the yarn guide arm can be reset solely by the force effect of the yarn generated in the direction of the yarn path when the yarn is deflected from the yarn path. Alternatively or additionally, the yarn accumulator unit can have further magnetically or mechanically spring-acting coupling elements, which are directed in the opposite direction to the magnetic force effect direction of the first and second coupling element and are configured to reset the yarn guide arm as required against the deflection direction by the first and second coupling element. These further coupling elements can be coupled to a drive unit and a control system coupled to the drive unit, in which case this coupling takes place in a preferred manner corresponding to the first and second coupling elements, such as the control system described above, as well as the sensor unit or a further sensor unit, in order to pivot the yarn guide arm as required.

In accordance with a further aspect of the present invention, a method for adjusting a yarn tension of a running yarn at a workstation in accordance with any of the embodiments described above is proposed. In this case, the sensor unit transmits sensor information about the rotary movement and/or position of the yarn guide arm to a control system assigned to the workstation. Based on the transmitted sensor information, the control system evaluates a magnetic force acting between the first and second coupling elements to identify a yarn tension applied to the yarn and, in the event of a deviation from a limit value or limit value range for the yarn tension that is evaluated as impermissible, controls the drive unit in a defined manner to change the position of the yarn guide arm as described above. As described at the beginning, the yarn tension can be kept constant during the package journey and controlled as required.

BRIEF DESCRIPTION OF THE DRAWINGS

An embodiment example of the present invention is explained below with reference to the drawings. In the drawings.

DESCRIPTION OF THE PREFERRED EMBODIMENTS

Figure 1:
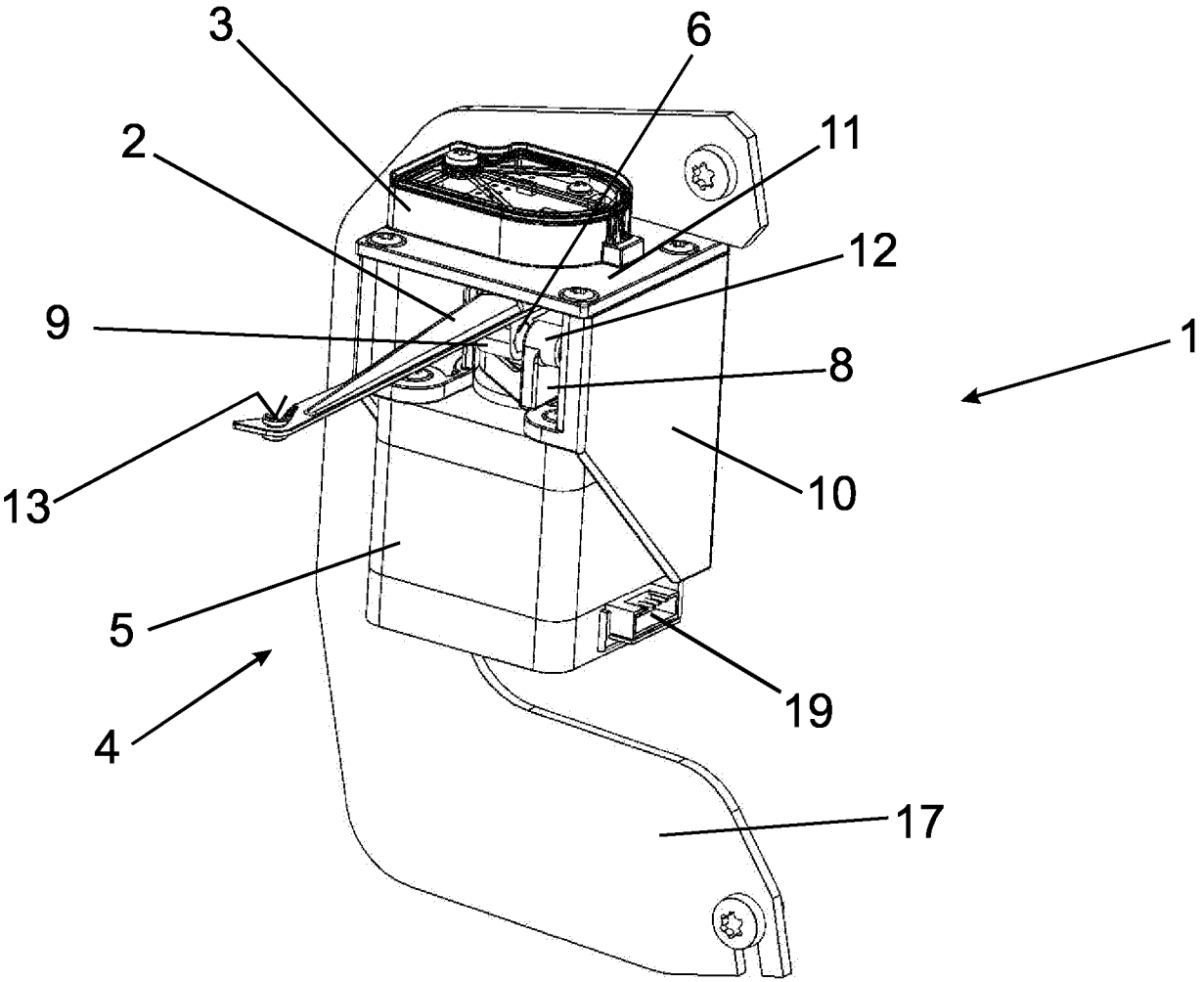
FIG. 1 is a perspective schematic view of a yarn accumulator unit according to an embodiment example.
Figure 2:
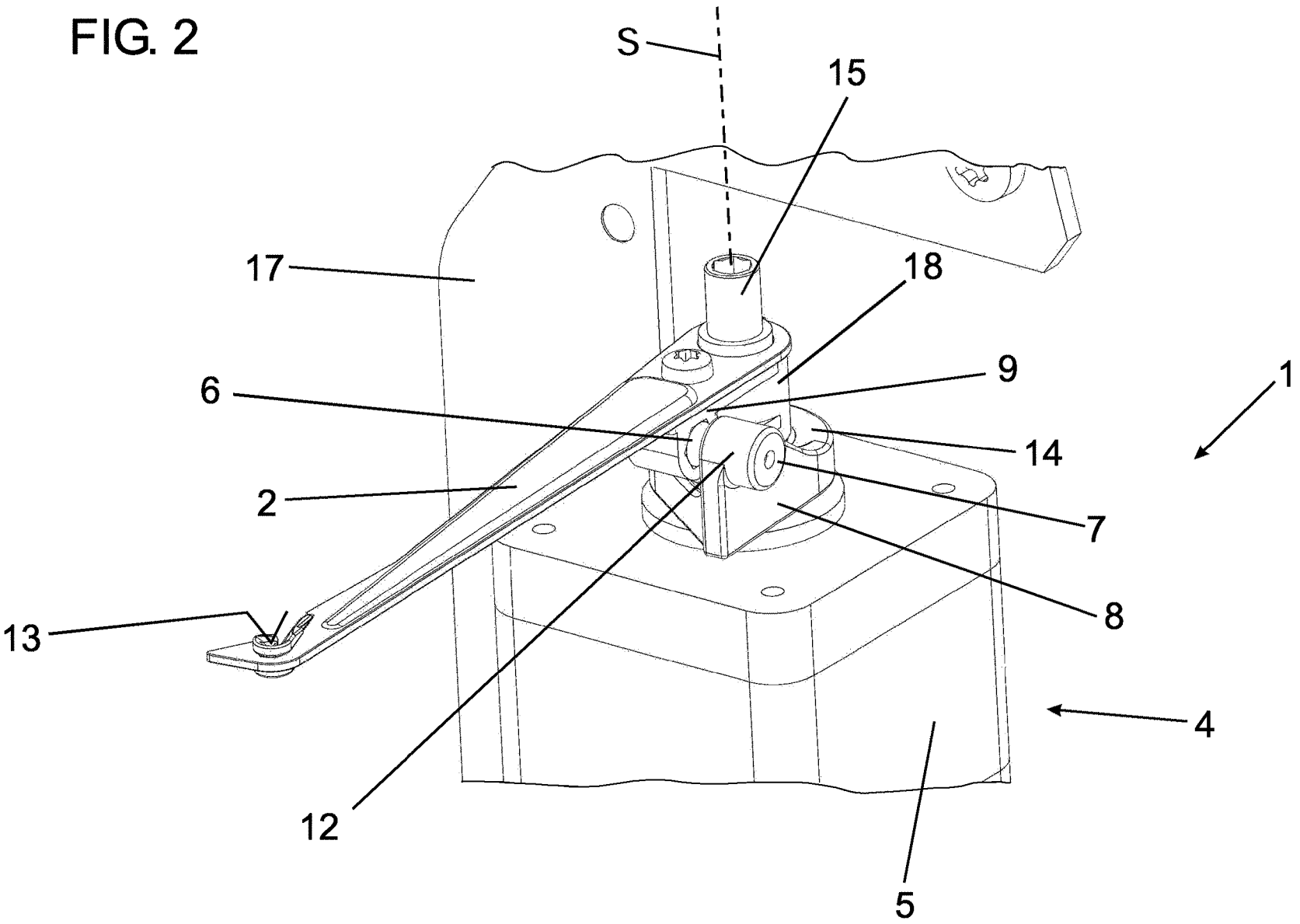
FIG. 2 is a perspective schematic view of an enlarged representation of a partial area of the yarn accumulator unit shown in FIG. 1.
Figure 3:
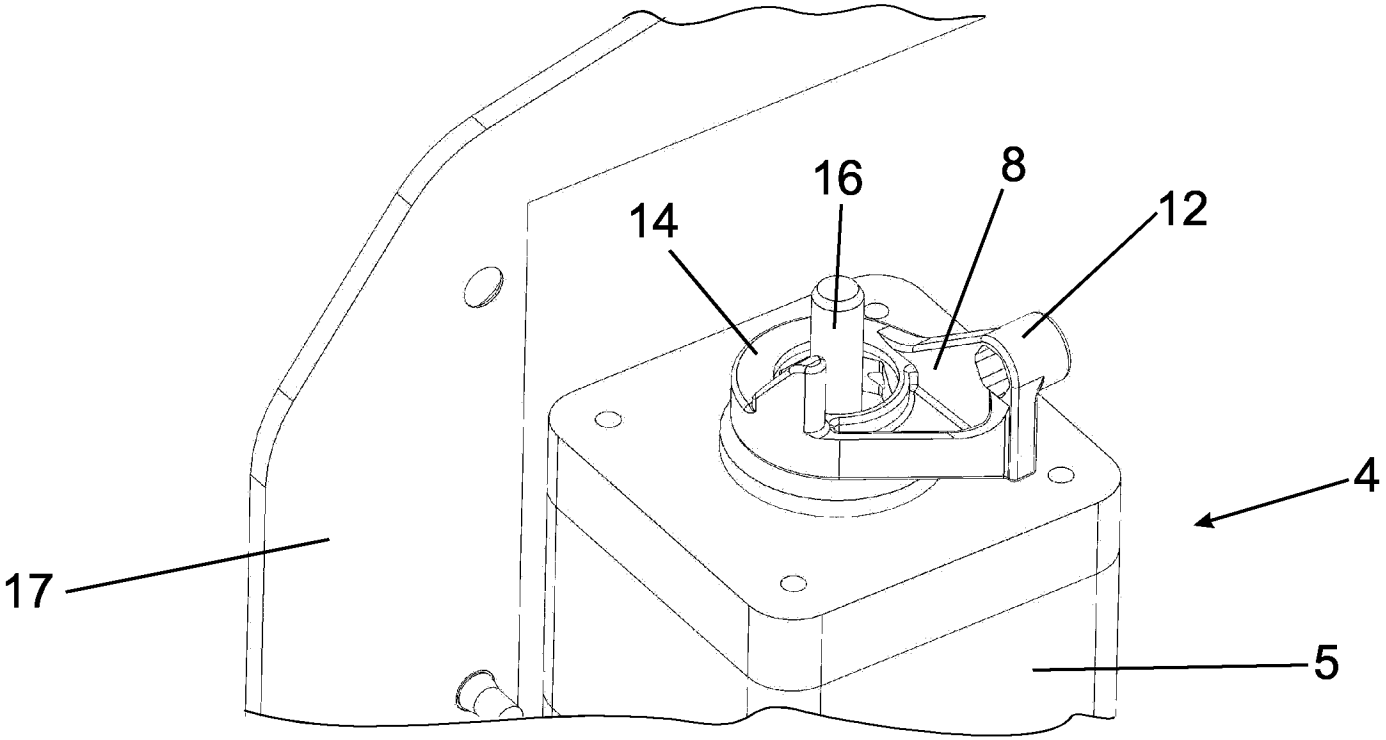
FIG. 3 is a perspective schematic view of an enlarged representation of the yarn accumulator unit shown in FIG. 1 without a yarn guide arm.
Figure 4:
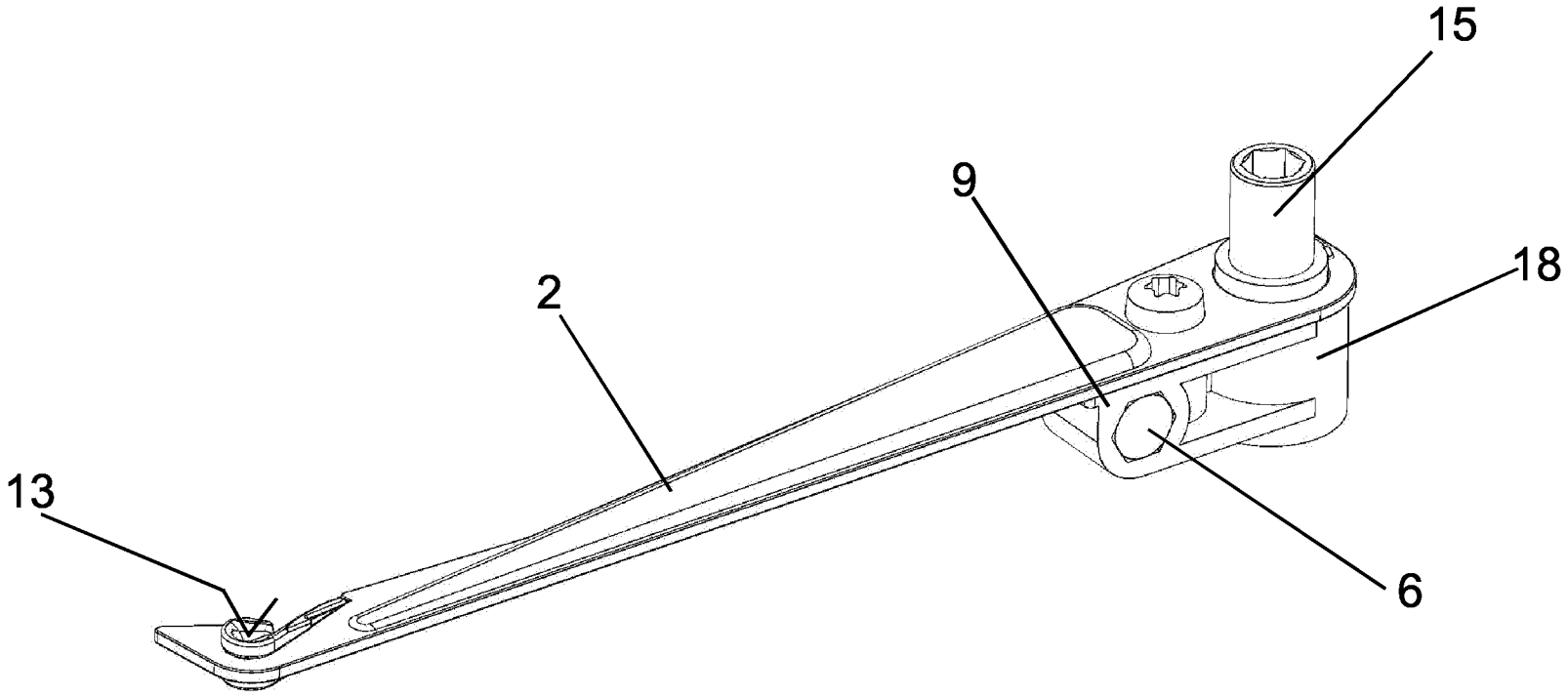
FIG. 4 is a perspective schematic view of the yarn guide arm of the yarn accumulator unit shown in FIG. 1.

FIG. 1 is a schematic perspective view of a yarn accumulator unit 1 according to an embodiment example, which is connected to a connection plate 17 for arrangement at a workstation, in particular a spinning or winding unit, of a textile machine not shown here. FIGS. 2 to 4 show, in a perspective schematic view, an enlarged representation of a partial area of the yarn accumulator unit 1 shown in FIG. 1 as well as a perspective schematic representation of a yarn guide arm 2 of this yarn accumulator unit 1.

The yarn accumulator unit 1 has a yarn guide arm 2, which is arranged at the workstation with a yarn guide eye 13 arranged at its free end in the yarn path F of a yarn to be wound onto a take-up package, the yarn being guided by the yarn guide eye 13. To form a yarn accumulator, the yarn guide arm 2 is pivotally mounted on a drive shaft 16 of an electric motor 5 of a drive unit 4 of the yarn accumulator unit 1, with for this purpose the yarn guide arm 2 having a bushing 18 for arrangement on the free end of the drive shaft 16 so that the yarn guide arm 2 is mounted on the drive shaft 16 without torque. The bushing 18 is further connected to a holder 9 connected to the yarn guide arm 2, which has an opening for receiving a first coupling element 6 configured as a permanent magnet.

For pivoting of the yarn guide arm 2 during loop-forming operation, the drive shaft 16 of the electric motor 5 is in a torsionally rigid connection with a coupling disc 14, which is arranged coaxially with respect to the drive shaft 16. A carrier 8 is arranged on the coupling disc 14, which has a further bushing 12 for receiving a further permanent magnet as the second coupling element 7. The permanent magnets on the yarn guide arm 2 and the carrier 8 are aligned with one another in such a way that they exert a repulsive magnetic effect on one another. A rotation of the coupling disc 14 via the reversing electric motor 5 thus causes, without contact, a corresponding pivoting of the yarn guide arm 2 about the drive shaft 16, which defines a pivot axis S, the electric motor 5 being controlled by a control system not shown here via connection 19.

For position detection of the yarn guide arm 2, a sensor unit 3 is arranged on a housing cover 11 of the housing 10 above—with reference to the drawing—the drive shaft 16, which sensor unit 3 is arranged with its sensor detecting the pivot angle coaxially with respect to a connection element 15 connected to the yarn guide arm 2, which in turn extends in the longitudinal axis direction of the drive shaft 16.

At least the rotary movement or the position of the yarn guide arm 2 can be determined particularly reliably via the sensor unit 3, and deviations of the yarn guide arm 2 from the position set by the drive unit 4 can be detected by means of transmitting corresponding sensor information to the control system about this. If, for example, the yarn tension increases, this causes a displacement of the yarn guide arm 2 in the direction of the second coupling element 7 against the spring force generated by the magnetic repulsive effect. Proceeding from this, the control system can then be used to move the coupling disc 14 back. If, for example, the yarn tension decreases in the course of a yarn sag, this causes a displacement of the second coupling element 7 by a rotation of the drive shaft 16 and of the carrier 8 coupled therewith, including the coupling disc 14 and the permanent magnet, in the direction of the yarn guide arm 2. The magnetic repulsive effect causes the yarn guide arm 2 to move in the same direction, which forces the guided yarn out of its path or further away from it, and forms or enlarges a yarn loop. In this way, a substantially constant yarn tension can be achieved and ensured during the entire winding process or package journey.

Figure 5:
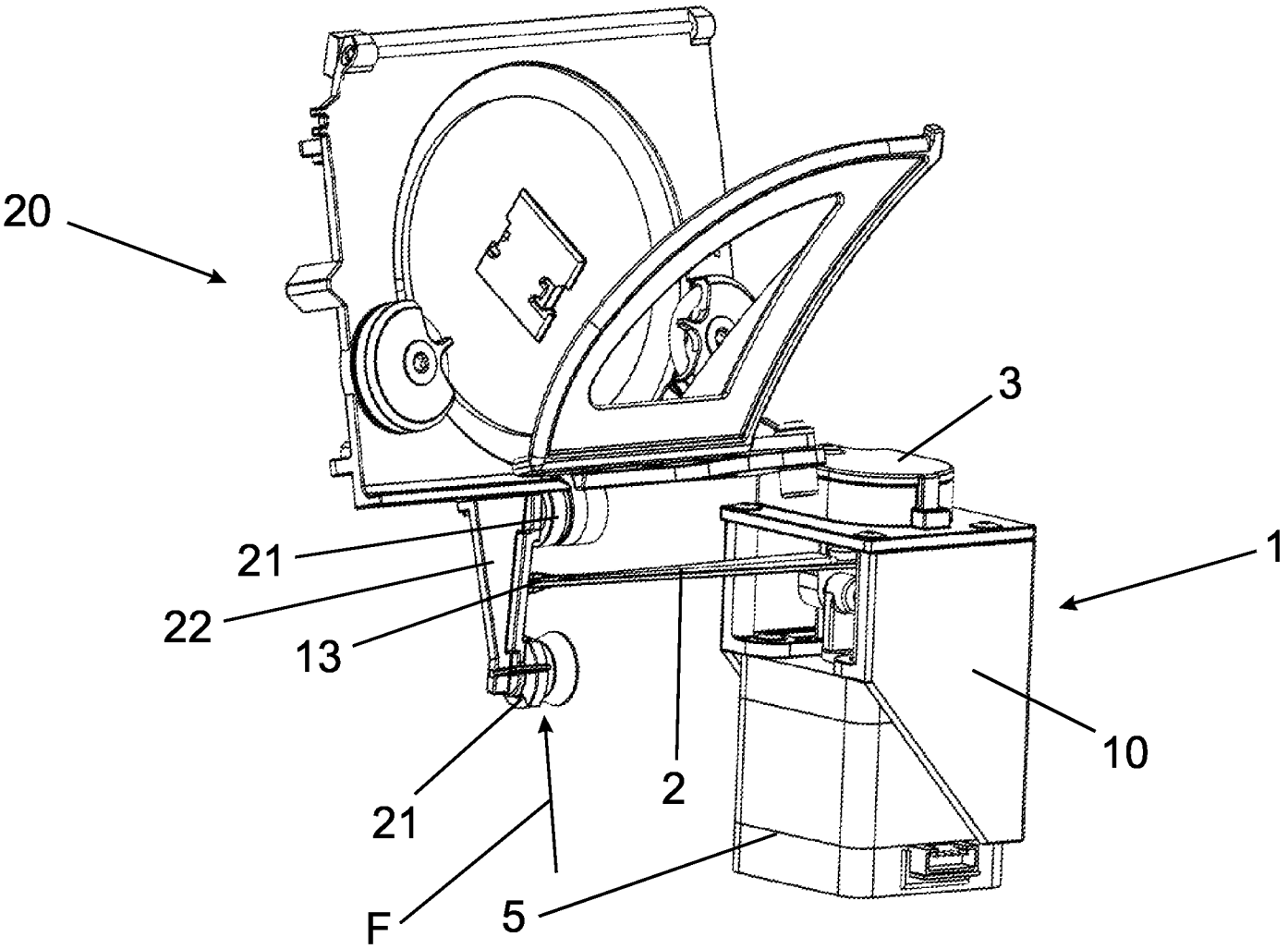
FIG. 5 is a perspective schematic view of the yarn accumulator unit shown in FIG. 1 in an arrangement upstream of a paraffining device.

FIG. 5 shows, in a perspective schematic view, an embodiment example of an arrangement of the yarn accumulator unit 1 at the workstation which is not shown, in which case the workstation can be a spinning or winding station. The yarn accumulator unit 1 is arranged along a yarn path F, which runs from a yarn delivery device that is not shown in the direction of a traversing device that is not shown, upstream of a paraffining device 20, which is arranged along the yarn path F of the traversing device and is shown only schematically and in parts. The paraffining device 20 has a holder 22 underneath, on which two yarn guide rollers 21 are rotatably held, over which the yarn can be guided partially entwined along the yarn path. The yarn accumulator unit 1 is positioned on the yarn path F in such a way that the yarn guide arm 2 can pivot into the yarn path F with its guide eye 13 in order to force the running yarn out of its yarn path F transversely to the arrangement direction of the yarn guide rollers 21. As a result of being forced out of its yarn path F by means of the yarn accumulator unit 1, the yarn comes into contact with the yarn guide rollers 21, by means of which a yarn loop of defined size is formed between the yarn guide rollers 21. The size of the yarn loop is varied by means of the yarn accumulator unit 1 as a function of the detected rotary movement or position of the yarn guide arm 2 via the control system, which controls the electric motor 5 and consequently the yarn guide arm 2, to set and regulate a yarn tension that is advantageously to be kept constant for the package journey, as required.

LIST OF REFERENCE SIGNS

1 Yarn accumulator unit
2 Yarn guide arm
3 Sensor unit
4 Drive unit
5 Electric motor
6 First coupling element
7 Second coupling element
8 Carrier
9 Holder
10 Housing
11 Housing cover
12 Further bushing
13 Yarn guide eye
14 Coupling disc
15 Connection element
16 Drive shaft
17 Connection plate
18 Bushing
19 Connection
20 Paraffining device
21 Yarn guide roller
22 Retainer
F Yarn path
S Pivot axis

What is claimed is:

1. A yarn accumulator unit for a workstation of a textile machine, with a yarn guide arm pivotally mounted about a pivot axis, and a controllable drive unit for reversing pivoting of the yarn guide arm, characterised in that the yarn guide arm is freely rotatably mounted and has a magnetically acting first coupling element arranged at a distance from the pivot axis, and the drive unit has a second magnetic coupling element which is arranged so as to be adjustable relative to the first coupling element, has a magnetically repulsive effect on the first coupling element, and is arranged so that it can be brought into active connection with the first coupling element, in which case an adjustment of the second coupling element in the direction of the first coupling element causes a displacement of the first coupling element in the same direction, characterised in that the second coupling element is arranged on a carrier which can be adjusted by the drive unit coaxially about the pivot axis of the yarn guide arm.

2. The yarn accumulator unit according to claim 1, characterised in that the first coupling element is detachably attached to the yarn guide arm.

3. The yarn accumulator unit according to claim 1, characterised in that the first coupling element and the second coupling element are configured as permanent magnets.

4. The yarn accumulator unit according to claim 1, characterised in that the yarn accumulator unit has a sensor unit assigned to it which is configured and arranged to detect rotary movement, or position, or both rotary movement and position of a connection element which is connected in a torsionally rigid manner to the yarn guide arm and is arranged in particular coaxially with respect to the drive shaft.

5. A yarn accumulator unit for a workstation of a textile machine, with a yarn guide arm pivotally mounted about a pivot axis, and a controllable drive unit for reversing pivoting of the yarn guide arm, characterised in that the yarn guide arm is freely rotatably mounted and has a magnetically acting first coupling element arranged at a distance from the pivot axis, and the drive unit has a second magnetic coupling element which is arranged so as to be adjustable relative to the first coupling element, has a magnetically repulsive effect on the first coupling element, and is arranged so that it can be brought into active connection with the first coupling element, in which case an adjustment of the second coupling element in the direction of the first coupling element causes a displacement of the first coupling element in the same direction, characterised in that the drive unit has an electric motor with a drive shaft which is connected to a carrier in a torsionally rigid manner and on which the yarn guide arm is mounted so that it can rotate freely.

6. A yarn accumulator unit for a workstation of a textile machine, with a yarn guide arm pivotally mounted about a pivot axis, and a controllable drive unit for reversing pivoting of the yarn guide arm, characterised in that the yarn guide arm is freely rotatably mounted and has a magnetically acting first coupling element arranged at a distance from the pivot axis, and the drive unit has a second magnetic coupling element which is arranged so as to be adjustable relative to the first coupling element, has a magnetically repulsive effect on the first coupling element, and is arranged so that it can be brought into active connection with the first coupling element, in which case an adjustment of the second coupling element in the direction of the first coupling element causes a displacement of the first coupling element in the same direction, characterised in that a carrier is arranged on a coupling disc which is arranged coaxially with the drive shaft and is connected to the drive shaft in a torsionally rigid manner.

* * * * *